United States Patent [19]

Scheurman, III

[11] 4,184,991

[45] Jan. 22, 1980

[54] CORROSION INHIBITING COMPOSITION FOR FERROUS METALS AND METHOD OF TREATING WITH SAME

[75] Inventor: Clarence Scheurman, III, Bay Village, Ohio

[73] Assignee: Zimmite Corporation, Westlake, Ohio

[21] Appl. No.: 886,146

[22] Filed: Mar. 13, 1978

[51] Int. Cl.[2] ..... C08K 5/29

[52] U.S. Cl. ..... 260/29.6 MN; 106/14.16; 252/394

[58] Field of Search ..... 526/6; 260/29.6 MN; 106/14.16, 14.37; 252/180, 394, 396

[56] References Cited

U.S. PATENT DOCUMENTS

| | | | |
|---|---|---|---|
| 3,085,916 | 4/1963 | Zimmie | 210/58 |
| 3,425,954 | 2/1969 | Ruzevick | 252/394 |
| 3,658,710 | 4/1972 | Puckorius | 210/58 |
| 3,720,616 | 3/1973 | Randell | 106/14.16 |
| 3,803,049 | 4/1974 | Korpics | 252/394 |
| 3,895,170 | 7/1975 | Tanaka | 106/14.16 |
| 3,985,503 | 10/1976 | O'Neal | 252/180 |

*Primary Examiner*—Paul R. Michl

[57] ABSTRACT

A composition and method for inhibiting corrosion of ferrous metals comprising treatment with an admixture of a benzotriazole, a tolyltriazole, a substituted benzotriazole or a substituted tolyltriazole, with an acrylic or methacrylic acid ester polymer. The combination of ingredients provides unexpectedly superior corrosion protection when compared with either ingredient employed separately.

11 Claims, No Drawings

CORROSION INHIBITING COMPOSITION FOR FERROUS METALS AND METHOD OF TREATING WITH SAME

INTRODUCTION

This invention relates to the corrosion inhibitor art, and more particularly to a novel and surprisingly effective composition for inhibiting general corrosion of ferrous metals. The invention also relates to a method of treating ferrous metals with the novel corrosion inhibiting composition.

The invention is particularly applicable to inhibiting the corrosion of ferrous metal components of cooling water systems of the recirculating type, such as are conventionally used in chemical and petrochemical plants, evaporative air conditioning systems and the like. It will be appreciated however that the invention also has utility in other environments where ferrous metals are subject to corrosive attacks of their surfaces by contact with water.

BRIEF DESCRIPTION OF THE INVENTION

The corrosion inhibiting composition of the present invention comprises an admixture of a compound selected from the group consisting of benzotriazoles, tolyltriazoles, substituted benzotriazoles (other than tolyltriazoles) and substituted tolyltriazoles; and a polymer formed of a lower alkyl ester of an organic acid selected from the group consisting of acrylic and methacrylic acids.

More particularly, the triazole compound is one selected from the group consisting of compounds having the formula

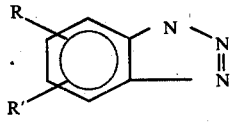

where R is H or $CH_3$; R' is H, a lower alkyl of 1–4 carbon atoms, $NO_2$, $NH_3$, Cl, or COOR", where R" is H or a lower alkyl of 1–4 carbon atoms.

Both laboratory and actual field experiments establish that the admixture of the triazole with the acrylic or methacrylic polymer produces a level of corrosion protection which surprisingly and unexpectedly exceeds by many fold, the corrosion protection effected by each ingredient taken individually.

STATE OF THE PRIOR ART

Neither of the two essential ingredients in applicant's novel composition is a newcomer to the corrosion inhibitor field.

Benzotriazoles, tolyltriazoles, substituted benzotriazoles and substituted tolyltriazoles are well known corrosion inhibitors for yellow metals, most notably copper and brass, and for aluminum. See for example Walker, *Triazole, Benzotriazole, and Naphthotriazole as Corrosion Inhibitors for Brass,* CORROSION, Vol. 32, No. 10, October 1976; and Walker, *Triazole, Benzotriazole, and Naphthotriazole as Corrosion Inhibitors for Copper,* CORROSION, Vol. 31, No. 3, March 1975.

Attempts have also been made to develop corrosion inhibitor systems based on triazoles which are effective in inhibiting the corrosion of ferrous metals. For example, U.S. Pat. No. 3,985,503 discloses the use of certain substituted benzotriazoles as inhibitors for iron, copper, aluminum, zinc, and alloys of these metals such as steel, brass, and the like. However, as shown in Tables 8 and 9 of this patent, it takes on the order of 300 to 500 parts per million of substituted benzotriazole before effective corrosion inhibition of steel in water is achieved.

To a similar effect is O'Neal, Jr., and Borger, *Corrosion Inhibiting Synergism by Triazoles in Aqueous Multimetal Systems,* MATERIALS PERFORMANCE, February 1976, which in Table 9 shows various triazoles at concentration levels of 10 and 20 parts per million to be virtually ineffective as corrosion inhibitors of steel.

Other prior art references known to be of general interest are U.S. Pat. Nos. 3,935,125, 3,886,481, 3,794,603 and Eldakar and Nobe, *Electrochemcial and Corrosion Behavior of Iron in the Presence of Substituted Benzotriazoles,* CORROSION, Vol. 33, No. 4, April 1977.

The other ingredient which is essential to applicant's corrosion inhibiting composition, viz, polymers based on esters of acrylic and methacrylic acid, have heretofore been used as dispersants in corrosion inhibitor systems to suspend and facilitate the removal of particulate corrosion products, and other finely divided materials such as silt. See for example, U.S. Pat. Nos. 3,085,916 and 3,658,710.

As far as the present inventor is aware, there is no prior art teaching of combining benzotriazoles, tolyltriazoles, a substituted benzotriazole, or a substituted tolyltriazole with an acrylic or methacrylic polymer, nor is there any prior art recognition that such a combination provides a level of corrosion inhibition for ferrous metals which exceeds by many fold the corrosion inhibiting effectiveness of either ingredient taken individually.

OBJECTS

It is therefore an object of the present invention to provide a novel and unexpectedly effective corrosion inhibiting composition.

A further object of the present invention is to provide a corrosion inhibiting composition which contains a compound selected from the group consisting of benzotriazoles, tolyltriazoles, substituted benzotriazoles (other than tolyltriazoles), and substituted tolyltriazoles, in admixture with a polymer formed of lower alkyl esters of organic acids selected from the group consisting of acrylic and methacrylic acids.

Yet another object of the invention is to provide a method of treating ferrous metal surfaces with the corrosion inhibiting composition of the present invention.

Further objects and advantages of the present invention will become apparent from the following detailed description thereof, which includes the best mode presently contemplated for practicing the invention.

DETAILED DESCRIPTION OF THE INVENTION

As noted above, one of the essential ingredients of the corrosion inhibiting composition of the present invention is a benzotriazole, a tolyltriazole, a substituted benzotriazole or a substituted tolyitriazole. More particularly, useful compounds are those selected from the group consisting of compounds having the formula

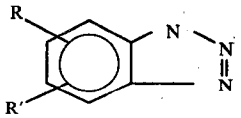

where R is H or $CH_3$; R′ is H, a lower alkyl of 1–4 carbon atoms, $NO_2$, $NH_3$, Cl, or COOR″, where R″ is H or a lower alkyl of 1–4 carbon atoms.

Specific examples of such triazoles useful in the practice of the present invention include tolyltriazoles, benzotriazoles, carboxybenzotriazoles, nitrotolyltriazoles, chlorobenzotriazoles, aminotolyltriazoles, and the butyltolyltriazoles.

The other essential ingredient in the corrosion inhibiting composition of the present invention is a polymer formed of lower alkyl (i.e. of 1–4 carbon atoms) of organic acids selected from the group consisting of acrylic and methacrylic acids. The polymers should be water soluble, and may have average molecular weights within the range of about 500 to about 100,000, and even higher, although polymers having average molecular weights within the range of about 500 to 10,000 are preferred.

Suitable species of polymers which are useful in the practice of the present invention include methyl acrylate, ethyl acrylate, and n-butylacrylate, methyl methacrylate, ethyl methacrylate, n-butyl methacrylate, and isobutyl methacrylate.

It has been found that the efficacy of the corrosion inhibiting composition of the present invention depends on two factors. First, the presence of a minimum, threshold concentration of triazole. Second, the observance of certain proportional ratios between triazole and polymer, as described move fully hereinafter.

Threshold concentration of triazole will vary over fairly wide limits depending on the nature and condition of the ferrous metal surfaces at the time treatment started, and the corrosiveness of the aqueous system to which the surfaces of the ferrous metal is exposed. In general, however, threshold concentrations within the range of about 2 to about 20 parts of million on a weight basis produces satisfactory results, with a preferred range being about 3 to about 8 parts per million on a weight basis.

As to the proportions of triazole and polymer, excellent results have been achieved where the relative concentrations of the triazole and polymer on a weight basis, are such as to provide a ratio of triazole to polymer within the range of about 0.5:1 to 3:1, and preferably 1:1 to 2.5:1.

One of the major applications of the corrosion inhibiting composition of the present invention is the protection of ferrous metal surfaces which are in continuous contact with recirculating water in water cooling systems. In treating such systems, it is conventional to inject aqueous solutions of corrosion inhibiting compositions directly into the system either on a continuous or periodic basis. To this end, a common practice is to prepare a concentrate in the form of an aqueous solution of active ingredients, and then meter the concentrate into the recirculating water system at a rate which dilutes the concentrate until the desired treating level of active ingredients is reached.

It is also a common practice to proportion the active ingredients in the concentrate so that the concentrate can be metered into the system at the rate of 100 to 200 parts per million. Thus for example, if it is desired to treat the system with triazole in a concentration of from 5 to 10 parts per million, then the concentrate would be prepared with a triazole concentration of 5% by weight. Then, when the concentrate is injected at the rate of 100 parts per million, this provides 5 parts per million of triazole. When the concentrate is injected in at the rate of 200 parts per million, this provides a concentration of 10 parts per million of triazole. The concentration of polymer is similarly adjusted to provide the desired ratio of triazole to polymer.

The corrosion inhibiting composition of the present invention may be augmented by the addition of other conventional materials, including different corrosion inhibitors, as well as surfactants, scale inhibitors, dispersants, pH adjustors, and the like.

Other corrosion inhibitors which may be incorporated in the composition of the present invention include compounds based on hexavalent chromate, polyphosphates, silicates, zinc compounds, and boron nitrites. Phosphonate scale inhibitors, such as aminomethyl phosphonate and hydroxyethylene diphosphonate may be included. Nonionic and anionic surfactants may also be used.

As noted above, the efficacy of the present invention has been established both in the laboratory and in the field. In both situations the level of corrosion protection afforded by the compositions of the invention was measured in terms of the rate of corrosion of mild steel coupons in mils (i.e. one one-thousandth of an inch) per year, following the procedure outlined in ASTM Designation Gl-72, entitled "Standard Recommended Practice For Preparing, Cleaning, And Evaluating Corrosion Test Specimens."

Laboratory Testing

A series of mild steel coupons measuring 178 inch by 3 inches by 1/16 inch in thickness were cleaned and preweighed in accordance with the procedure described in ASTM Gl-72. The coupons were then immersed in a flask containing Cleveland tap water in which was dissolved the corrosion inhibiting compound or admixture being tested. The solution was maintained in a mild state of agitation by the use of a magnetic stirrer.

After seven days of immersion in the water solution, the coupons were removed, and cleaned and tested for corrosion rate in accordance with the procedure described in ASTM Gl-72. The rates of corrosion were calculated on the basis of mils per year.

The following compositions were tested for corrosion inhibition (parts per million—ppm—are by weight):

Example 1 Poly methacylate alone (average molecular weight 4500) at the rate of 2 ppm.
Example 2 Tolyltriazole alone at the rate of 5 ppm.
Example 3 Carboxybenzotriazole alone at the rate of 5 ppm.
Example 4 Nitrotolyltriazole alone at the rate of 5 ppm.
Example 5 A mixture of examples 1 and 2.
Example 6 A mixture of examples 1 and 3.
Example 7 A mixture of examples 1 and 4.

Table 1 below summarizes the corrosion rate data generated from laboratory testing as described above in connection with examples 1 through 7.

TABLE 1

| Example No. | Corrosion Inhibitor | Rate(mpy) |
|---|---|---|
| 1 | 2ppm polymethacrylate | 28.1 |
| 2 | 5ppm tolyltriazole | 17.7 |
| 3 | 5ppm carboxybenzotriazole | 19.8 |
| 4 | 5ppm nitrotolyltriazole | 16.2 |
| 5 | 5ppm tolyltriazole 2ppm polymethacrylate | 4.0 |
| 6 | 5ppm carboxybenzotriazole 2ppm polymethacrylate | 1.2 |
| 7 | 5ppm nitrotolyltriazole 2ppm polymethacrylate | 1.0 |

These data show a remarkable reduction in the rate of corrosion when there is added to 5 ppm of a triazole, a proportion of a methacrylate polymer which provides a triazole to polymer ratio of 2.5:1.

Ignoring the corrosion inhibiting rate of the polymer by itself (which is virtually nil), it will be seen that the corrosion rate of 17.7 mpy obtained when 5 ppm of tolyltriazole is used alone, is reduced by the addition of polymer, to 4.0 mpy, better than a four fold improvement.

Even more dramatically, a corrosion rate of 19.8 mpy obtained with 5 ppm of carboxybenzotriazole alone, was reduced by the addition of polymer, to a rate of 1.2 mpy, a better than sixteen fold improvement. Finally, the corrosion rate of 16.2 mpy obtained with 5 ppm of nitrotolytriazole alone, was reduced by the addition of polymer, to a rate of 1.0 mpy, again better than a sixteen fold improvement.

Experience indicates that these laboratory tests results correlate well with field testing. Coupons which show a rate of corrosion of 5 mpy or less are considered to be adequately protected against corrosion, and the inhibitor systems which provide such protection are deemed to be commercially acceptable.

Field Testing

EXAMPLE 8

A corrosion inhibiting composition of the present invention was tested in a water cooling tower operated in conjunction with a petrochemical plant. The tower recirculates water at the rate of 1800 gpm, and the tower effects a 15° F. temperature change in the recirculating water.

The cooling water analyzed as follows:

| | |
|---|---|
| Total dissolved solids | 400–500ppm |
| Alkalinity (to a methyl orange end point with $H_2SO_4$) | 120–200ppm |
| Calcium hardness (as calcium carbonate) | 150–240ppm |
| pH | 8.3 |

Prior to treatment with the corrosion inhibitor of the present invention, the tower was treated with a polyphosphate corrosion inhibitor. The corrosion rate of mild steel coupons placed in the tower while under treatment with the polyphosphate inhibitor, and tested in accordance with the ASTM Gl-72, was about 11.2 mpy.

The tower was treated with an admixture of tolyltriazole and a polymethacrylate polymer having an average molecular weight of 4500 in proportions to provide from 3 to 4 ppm of triazole, and a triazole to polymer ratio of 2:1.

Within a period of three weeks, the corrosion rate of coupons placed in the system and tested in accordance with ASTM Gl-72 drops to 0.4 mpy, and this rate has remained constant.

EXAMPLE 9

A coke plant cooling tower was treated with a corrosion inhibitor of the present invention. The tower recirculates 15,000 gpm with a 25° F. water temperature differential through the tower.

The specifications of the cooling water were found to be as follows:

| | |
|---|---|
| Total dissolved solids | 220–400ppm |
| Alkalinity (to a methyl orange end of point with $H_2SO_4$) | 20–40ppm |
| Calcium hardness (measured as calcium carbonate) | 120–180ppm |
| pH | 6.9–7.4. |

The previous treatment of the tower water consisted of a mixture of a polyphosphate corrosion inhibitor and a phosphonate scale inhibitor. The corrosion rate of mild steel coupons introduced into the tower while the previous treatment was still in effect, was in excess of 22 mpy, when measured in accordance with ASTM Gl-72.

The previous corrosion inhibiting system was replaced by an admixture of tolyltriazole and polymethacrylate which provided the system with a concentration of triazole within the range of 3 to 4 ppm, and a ratio of triazole to polymer of 2:1.

Almost immediately it was found that the corrosion rate of mild steel coupons placed in the system was reduced to 2.2 mpy, and after a period of seven weeks, the corrosion rate was further reduced to 0.7 mpy, and the rate stabilized at that lower level. After eight months of monitoring, the corrosion rate has remained at the 0.7 mpy level.

Having thus described my invention I claim:

1. A composition useful for inhibiting corrosion of ferrous metals in aqueous systems comprising an aqueous vehicle containing from about 2 to about 20 ppm by weight of a compound selected from the group consisting of compounds having the formula

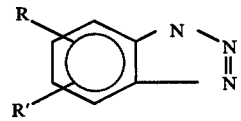

where R is H or $CH_3$; R' is H, a lower alkyl of 1–4 carbon atoms, $NO_2$, $NH_3$, Cl, or COOR", where R" is H or a lower alkyl of 1–4 carbon atoms; and a water soluble polymer formed of lower alkyl esters of organic acids selected from the group consisting of acrylic and methacrylic acids, wherein the relative concentrations of compound and polymer on a weight basis are such as to provide a ratio of compound to polymer within the range of about 0.5:1 to 3:1.

2. A corrosion inhibiting composition as defined in claim 1 wherein the concentration of said compound on a weight basis is within the range of about 3–8 ppm.

3. A corrosion inhibiting composition as defined in claim 2 wherein the relative concentrations of said compound and said polymer on a weight basis are such as to provide a ratio of compound to polymer within the range of about 1:1 to 2.5:1.

4. The composition defined in claim 1 wherein said compound is carboxybenzotriazole.

5. The composition defined in claim 1 wherein said compound is carboxybenzotriazole and said polymer is polymethacrylate.

6. The composition defined in claim 5 wherein said carboxybenzotriazole is present in a concentration on a weight basis within the range of about 3–8 ppm and the ratio of compound to polymer on a weight basis is within the range of about 1:1 to 2.5:1.

7. The composition defined in claim 1 wherein said compound is a tolyltriazole.

8. The composition defined in claim 1 wherein said compound is nitrotolyltriazole.

9. The composition defined in claim 7 wherein said polymer is poly methacrylate.

10. The composition defined in claim 8 wherein said polymer is poly methacrylate.

11. A method of inhibiting corrosion of ferrous metal surfaces due to the exposure of such surfaces to water, which comprises treating such water with a composition comprising an aqueous vehicle containing from about 2 to about 20 ppm on a weight basis of a compound selected from the group consisting of compounds having the formula

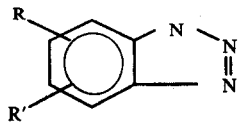

where R is H or $CH_3$; R' is H, a lower alkyl of 1–4 carbon atoms, $NO_2$, $NH_3$, Cl or COOR", where R", is H or a lower alkyl of 1–4 carbon atoms; and a water soluble polymer formed of lower alkyl esters of organic acids selected from the group consisting of acrylic and methacrylic acids, wherein the relative concentrations of compound and polymer on a weight basis are such as to provide a ratio of compound to polymer within the range of about 0.5:1 to 3:1.

* * * * *

UNITED STATES PATENT AND TRADEMARK OFFICE

CERTIFICATE OF CORRECTION

PATENT NO. : 4,184,991

DATED : Jan. 22, 1980

INVENTOR(S) : Clarence Scheurman, III

It is certified that error appears in the above-identified patent and that said Letters Patent are hereby corrected as shown below:

In Column 2, line 66, "tolyitriazole" should be --tolyltriazole--.

In Column 4, line 38, "178" should be --1/2--.

Signed and Sealed this

*Third* Day of *June 1980*

[SEAL]

*Attest:*

SIDNEY A. DIAMOND

*Attesting Officer*

*Commissioner of Patents and Trademarks*